US006736220B1

(12) United States Patent
Chan et al.

(10) Patent No.: US 6,736,220 B1
(45) Date of Patent: May 18, 2004

(54) POWER TOOL TRIGGER ASSEMBLY

(75) Inventors: Kai Chi Chan, Chaiwan (HK); Man Ting Ho, Chaiwan (HK)

(73) Assignee: Defond Components Limited, Chaiwan (HK)

( * ) Notice: Subject to any disclaimer, the term of this patent is extended or adjusted under 35 U.S.C. 154(b) by 0 days.

(21) Appl. No.: 10/442,965

(22) Filed: May 22, 2003

(51) Int. Cl.[7] ..... B25B 23/00

(52) U.S. Cl. ..... 173/170; 310/50; 200/1 V; 200/16 R; 200/157; 200/522; 173/217

(58) Field of Search ..... 173/2, 170, 171, 173/217; 310/47, 50; 200/1 V, 6 R, 16 B, 16 R, 509, 157, 522, 244

(56) References Cited

U.S. PATENT DOCUMENTS 3,143,606 A * 8/1964 Brown ..... 200/6 R
3,260,827 A * 7/1966 Frenzel ..... 200/522
3,467,801 A * 9/1969 Matthews ..... 200/1 V
3,632,936 A * 1/1972 Piber ..... 200/1 V
4,284,109 A * 8/1981 Kimer et al. ..... 140/122
4,667,119 A * 5/1987 Holmes ..... 307/326
5,653,296 A * 8/1997 Fujiyama ..... 173/217
6,244,358 B1 * 6/2001 Beer et al. ..... 173/178

* cited by examiner

*Primary Examiner*—Scott A. Smith
(74) *Attorney, Agent, or Firm*—Leydig, Voit & Mayer, Ltd.

(57) ABSTRACT

A trigger assembly for controlling an electric power tool including a motor comprises a base for fixing within the power tool and a trigger supported by the base for inward and outward movement. The base has a housing, a first mechanical switch provided in the housing and operable to switch on and off the motor, and an electronic operating circuitry provided in the housing for controlling the operation of the motor when the first switch is closed. The base includes a slider guided within the housing for movement by the trigger to operate the first switch and the operating circuitry. Also included is a second mechanical switch provided within the housing and operable in response to the movement of the trigger to switch on and off an auxiliary device for the power tool. The auxiliary device is located externally of the base and is operable independently of the operating circuitry.

15 Claims, 7 Drawing Sheets

POWER TOOL TRIGGER ASSEMBLY

The present invention relates to a trigger assembly for an electric power tool.

BACKGROUND OF THE INVENTION

The operation of electric hand drills is often controlled by means of a pull-trigger, which is used to switch on and off the motor as well as to adjust its speed/torque. Certain auxiliary electronic/electrical devices, such as battery and level meters, may be preferred. It will be convenient if such devices can also be controlled using the pull-trigger.

The invention seeks to provide a new trigger assembly that can readily be used to control the operation of such auxiliary devices.

SUMMARY OF THE INVENTION

According to the invention, there is provided a trigger assembly for controlling the operation of an electric power tool including an electric motor, comprising a base for fixing within the power tool and a trigger supported by the base for inward and outward movement. The base comprises a housing, a first mechanical switch provided in the housing and operable to switch on and off the motor, and an electronic operating circuitry provided in the housing for controlling the operation of the motor when the first switch is closed. The base includes a slider guided within the housing for movement by or with the trigger to operate the first switch and the operating circuitry. Also included is a second mechanical switch provided within the housing and operable in response to the movement of the trigger to switch on and off an auxiliary device for the power tool. The auxiliary device is located externally of the base and is operable independently of the operating circuitry.

Preferably, the trigger is resiliently biassed towards a foremost home position, and the second switch is open when the trigger is in the home position and will be closed when the trigger is moved away from the home position.

In a preferred embodiment, the second switch comprises a stationary contact and a movable contact resiliently biassed towards the stationary contact.

More preferably, the trigger is resiliently biassed towards a foremost home position, and the movable contact of the second switch is moved out of contact from the stationary contact by the slider while the trigger is in the home position.

More preferably, the movable contact of the second switch is engageable by the slider against the action of resilience.

Further more preferably, the slider has a front bottom part for abutting the movable contact of the second switch.

More preferably, the movable contact of the second switch is cantilevered for pivotal movement.

More preferably, one of the contacts of the second switch is connected to positive electrical connection of the operating circuitry.

It is preferred that the first and second switches are operable by respective first and second parts of the slider that are adjacent each other, the first part having a surface for slidably engaging a moving contact of the first switch.

It is further preferred that the surface is discontinuous to minimise the risk of breakdown or flashover therealong.

It is yet further preferred that the surface includes a groove.

In a specific construction, the housing has an upper portion housing the slider and a lower portion including a front cavity housing the second switch.

More specifically, the housing has a frontmost outer wall and an inner wall behind the outer wall, the two walls defining the cavity.

The invention also provides an electric power tool including an electric motor and the aforesaid trigger assembly.

In one example, the electric power tool is an electric hand drill.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
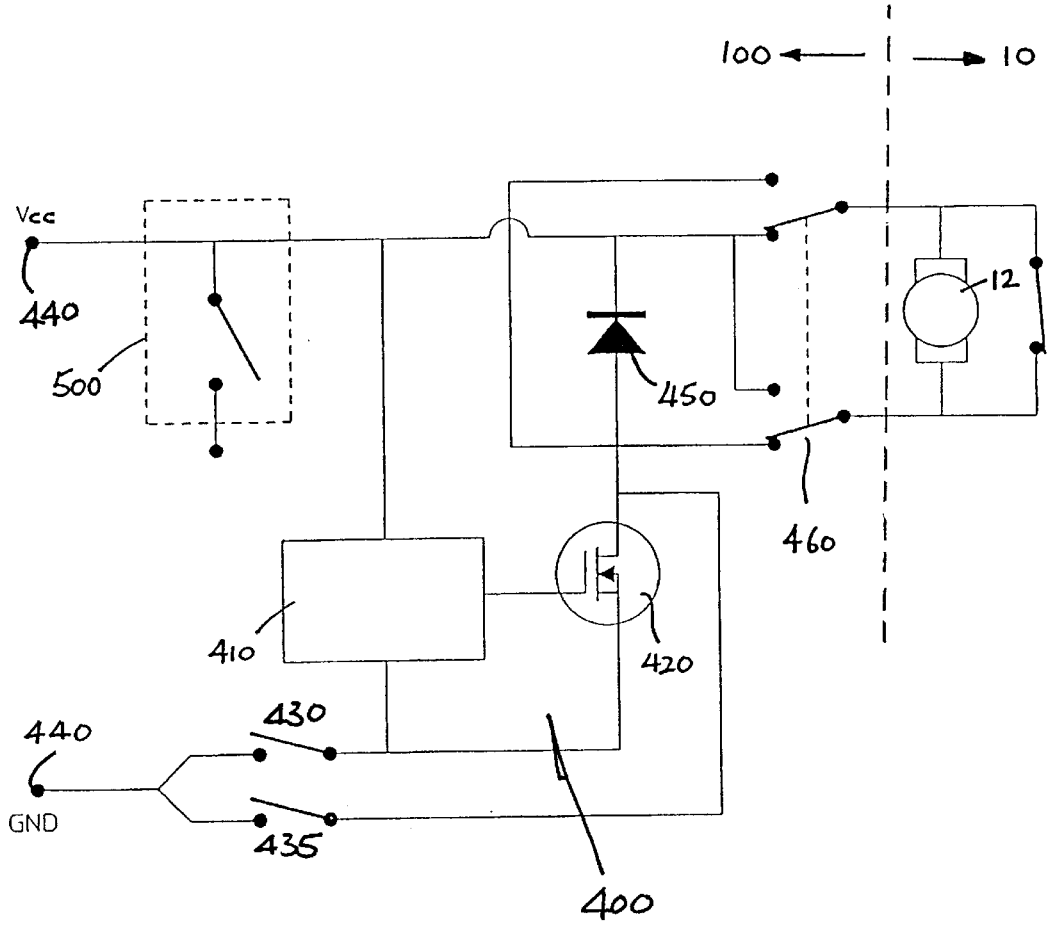
FIG. 1 is a simplified circuit diagram of an embodiment of a trigger assembly in accordance with the invention, connected to an electric power tool incorporating a motor.
Figure 2:
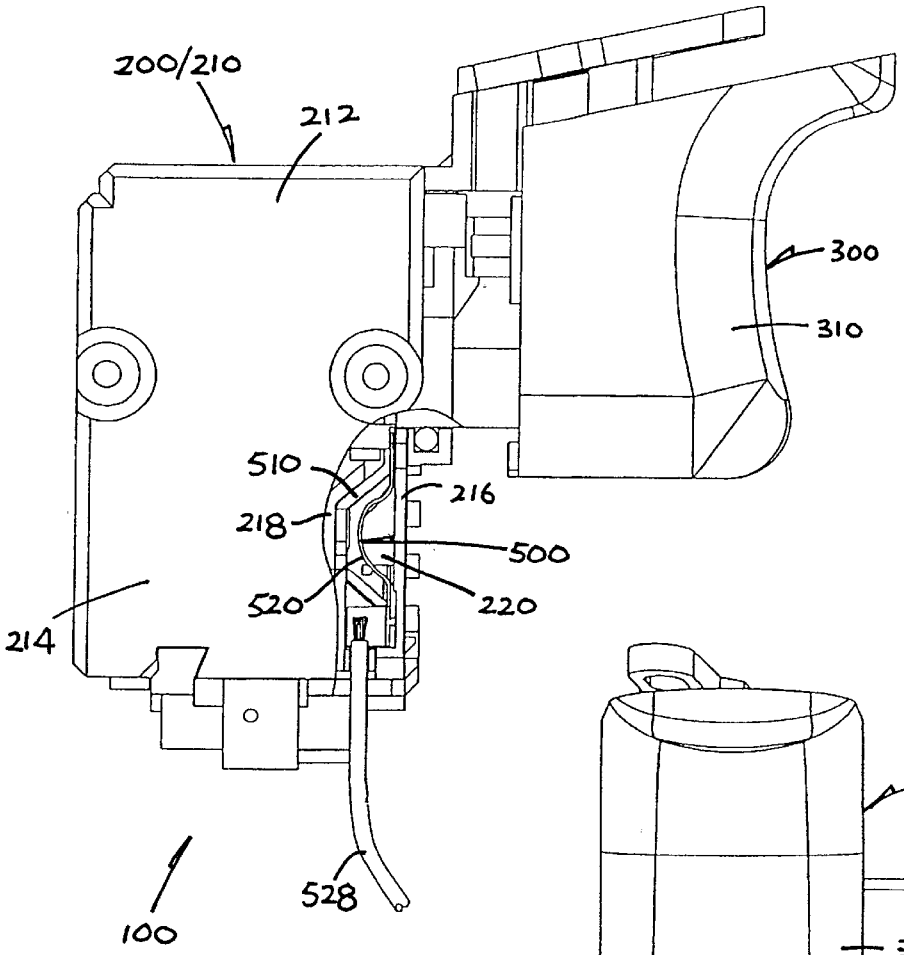
FIG. 2 is a right side view of the trigger assembly of FIG. 1, partially broken to reveal a built-in switch thereof.
Figure 3:
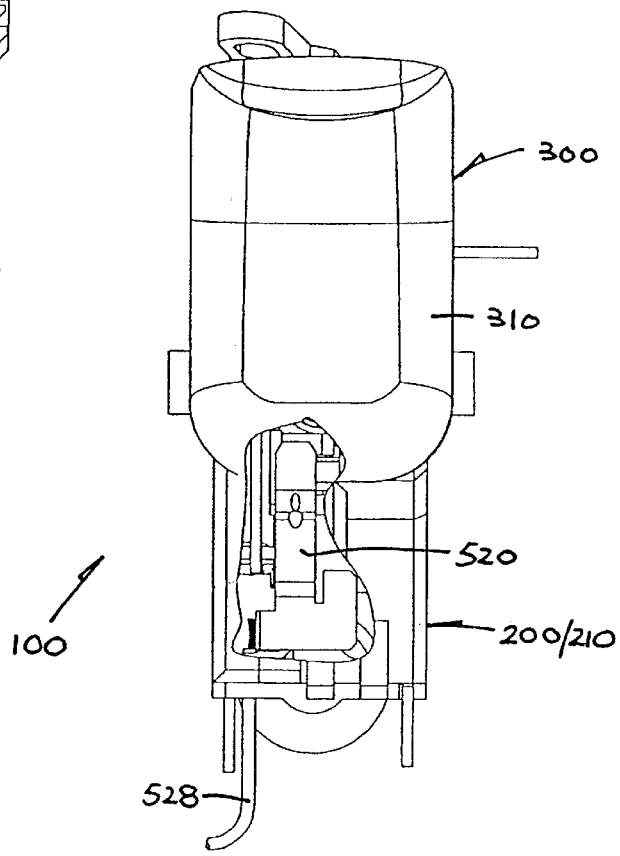
FIG. 3 is a front view of the trigger assembly of FIG. 2.
Figure 4:
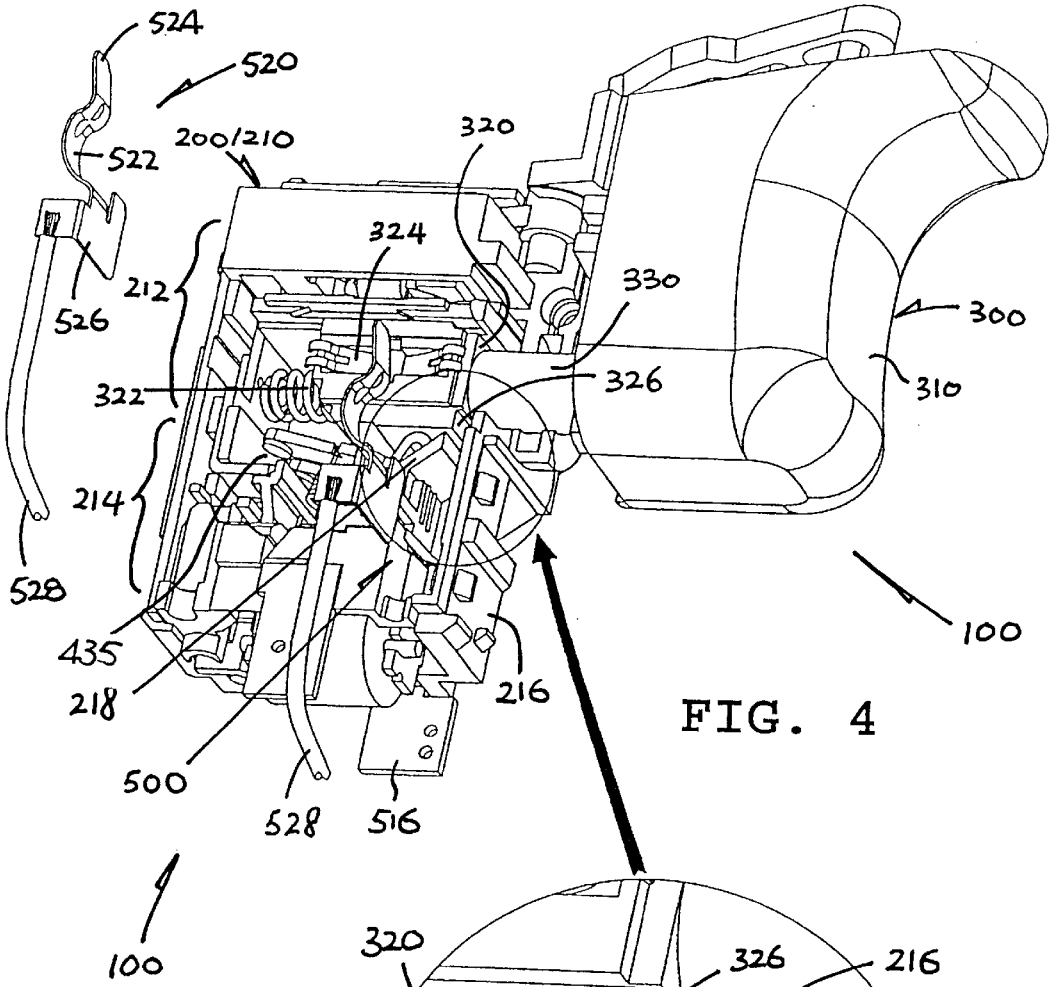
FIG. 4 is a right side perspective view of the trigger assembly of FIG. 2, with a moving contact of the built-in switch disassembled.
Figure 4A:
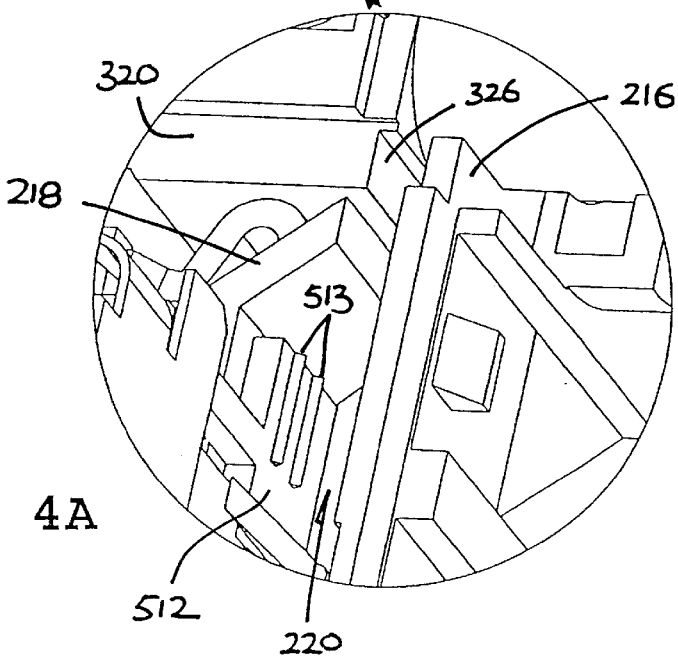
FIG. 4A is an enlarged part of FIG. 4 as encircled.
Figure 5:
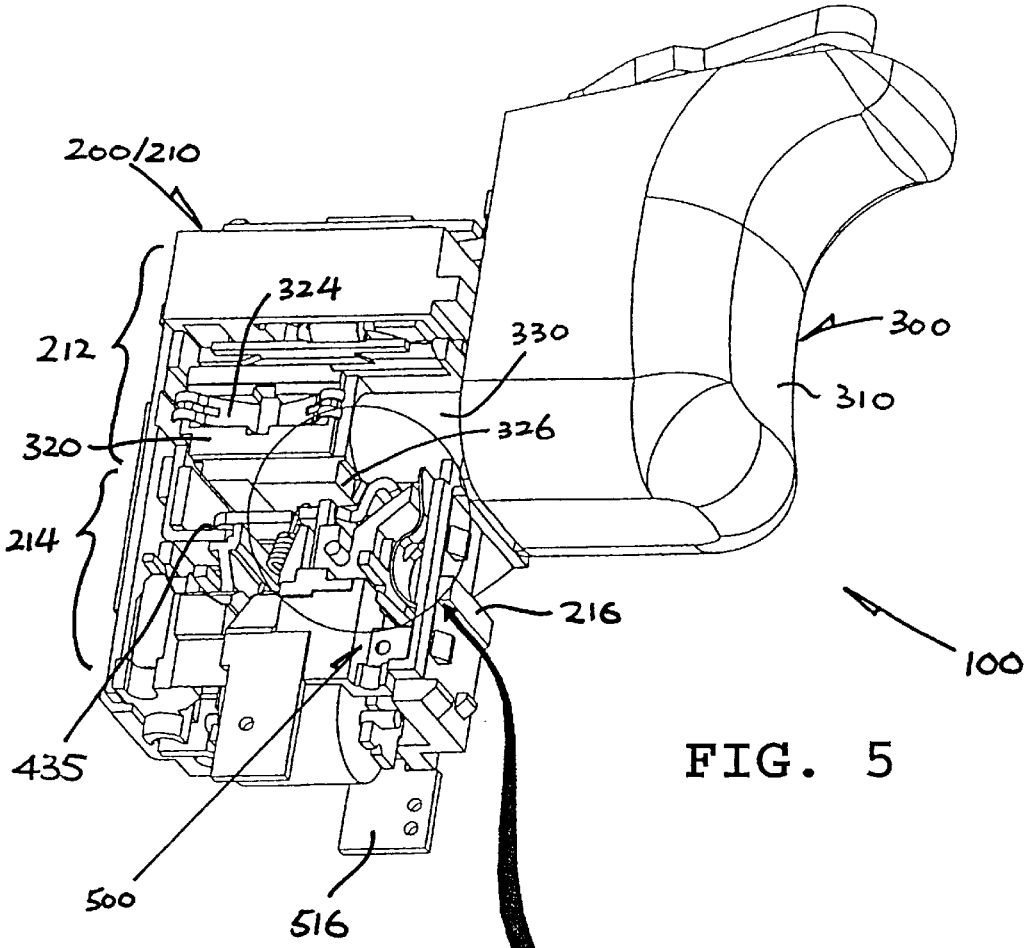
FIG. 5 is a right side perspective view corresponding to FIG. 4, showing the moving contact assembled.
Figure 5A:
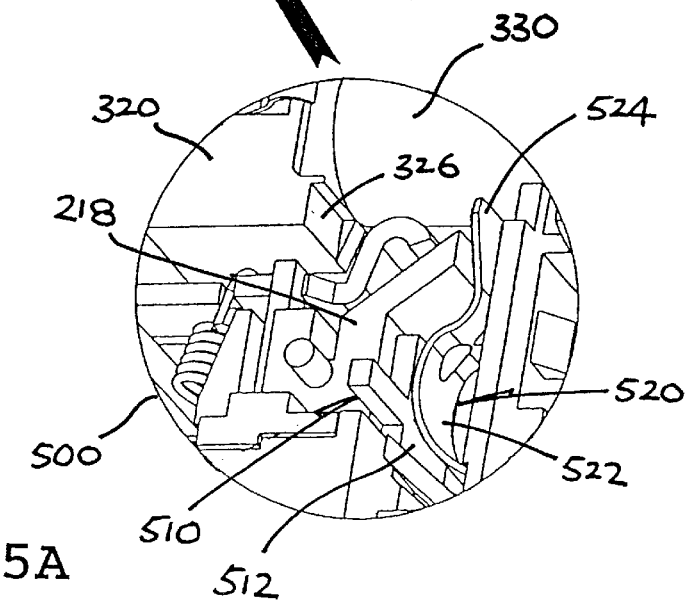
FIG. 5A is an enlarged part of FIG. 5 as encircled.

Referring to the drawings, there is shown a trigger assembly 100 embodying the invention for controlling the operation of an electric power tool such as a hand drill 10 that incorporates an electric motor 12. The trigger assembly 100 comprises an upright generally rectangular base 200 fixed inside the drill body adjacent the upper end of its handgrip and a pull-trigger 300 supported by the base 200 for inward (rearward) and outward (forward) horizontal sliding movement. A housing 210 of the base 200 has an upper portion 212 from inside which the pull-trigger 300 extends forwards, and a lower portion 214 that includes a frontmost vertical outer wall 216 and an inner wall 218 at a small distance behind the outer wall 216. The two walls 216 and 218 define a narrow cavity 220 housing a mechanical built-in switch 500.

The trigger assembly 100 incorporates, as contained within its base housing 210, an electronic operating circuitry 400 which comprises an IC control circuit 410 and a solid-state switch 420 controlled by the circuit 410. A mechanical main switch 430 operated by the pull-trigger 300 is also contained within the housing 210. The two switches 420 and 430 are connected in series with the motor 12 across positive (Vcc) and negative (GND) terminals 440 of a rechargeable DC battery pack for the hand drill 10. In use, the main switch 430 switches on the motor 12 upon (or shortly after) pulling back of the pull-trigger 300 and later switches it off when the pull-trigger 300 returns to its initial foremost (outermost) home position. While the main switch 430 is closed, the solid-state switch 420 controls the operation of the motor 12.

The control circuit 410 comes into operation upon closing of the main switch 430, whereupon it triggers the solid-state switch 420 to switch on and off at a relatively high frequency having a variable duty cycle according to the travelling position of the pull-trigger 300 for adjusting the speed/torque of the motor 12. A flywheel diode 450 and a double-pole double-throw reversal switch 460 are connected across the terminals of the motor 12. The flywheel diode 450 is connected to the motor 12 by the reversal switch 460 only when the reversal switch 460 switches the motor 12 to run in the forward direction. The flywheel diode 450 allows the motor current to continue to flow while the solid-state switch 420 is non-conducting while switching.

Another mechanical, bypass switch 435, also operated by the pull-trigger 300, is connected in parallel with the main and solid-state switches 430 and 420 for bypassing them, which is connected from the negative (GND) battery terminal 440 to beyond the solid-state switch 420. The bypass switch 435 will be closed when the pull-trigger 300 is (almost) fully pulled back for bypassing the solid-state switch 420, thereby delivering full power directly to the motor 12 for maximum speed/torque operation.

The pull-trigger 300 has a body 310 exposed for manual pulling, a generally rectangular core slider 320 guided within the upper portion 212 of the base housing 210 for back and forth sliding movement, and a horizontal shaft 330 interconnecting the trigger body 310 and slider 320 for simultaneous movement. The core slider 320, which is resiliently biassed forwards from behind by a compression coil spring 322, carries on its right side a four-pronged sliding contact 324. The contact 324 bears slidably against a row of contact strips on a circuit board mounting the control circuit 410 for selectively making contact therewith, as the slider 320 is pushed inwards by the trigger body 310 or outwards by the spring 322 upon release of the trigger body 310. The sliding position of the contact 324 determines the duty cycle of the trigger signal generated by the control circuit 410 for switching on and off the solid-state switch 420.

Figure 9:
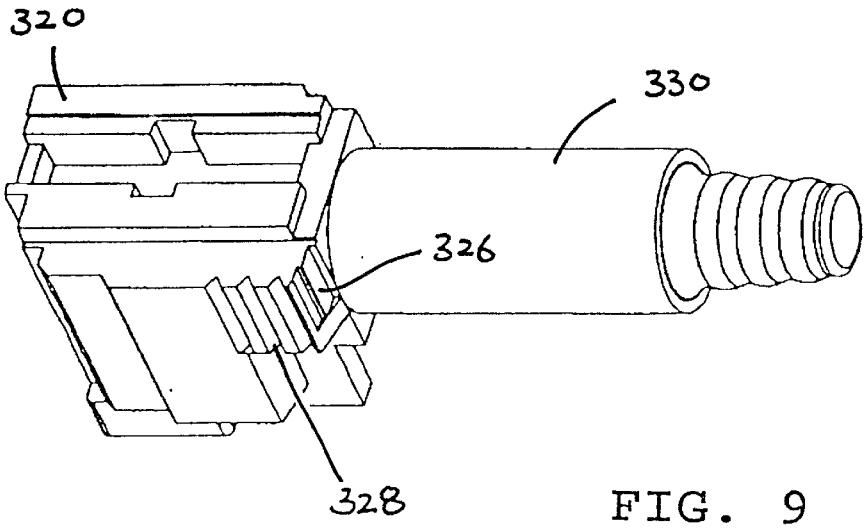
FIG. 9 is a perspective view of the slider of FIG. 8, showing it in greater detail.

The travel of the core slider 320 is limited by opposite front and rear ends of the interior of the upper portion 212 of the base housing 210. Under the action of the spring 322, the slider 320 normally stays foremost, bearing against an upper end of the housing wall 216. The slider 320 has a shallow end recess 326 at its front bottom corner on the right side and adjacent the upper end of the wall 216, and includes a pair of cams on its bottom surface for operating the main and bypass switches 430 and 435. The lower surface of the cams taken as a whole, over a relatively short region thereof adjacent or leading to the end recess 326, is formed with a series of three grooves 328 (FIG. 9). The grooves 328 run transversely (or at an acute angle) across the complete width of this region, thereby interrupting the surface to render it discontinuous or lengthen its surface length over this region.

The detailed construction and operation of the main and bypass switches 430 and 435 are described in a related utility patent application Ser. No. 10/443,060 entitled "Power Tool Trigger Assembly" filed on the same day in the name of the same inventors, the disclosure thereof is hereby incorporated by reference. In particular, the main and bypass switches 430 and 435 make use of respective contact levers as moving contacts that are pivotable through sliding engagement by the aforesaid cams of the core slider 320 for making and breaking contact.

The built-in switch 500 is formed by a rigid stationary contact bar 510 and a resilient movable contact lever 520 positioned right in front of the contact bar 510 for flexing into contact therewith or flexing out of contact therefrom, to perform a switching action. The contact lever 520 is biassed towards or against the contact bar 510 by virtue of self-resilience.

The contact bar 510 has a flat middle section 512 for contact by the contact lever 520, a crooked upper end 514 extending laterally across the core slider 320 and connected to positive electrical connection (Vcc) of the control circuit 410, and a 90°-turned lower end 516. The middle section 512 is housed within the cavity 220, whilst the upper and lower ends 514 and 516 emerge through opposite ends of the cavity 220. Two sharp ribs 513 on the surface of the middle section 512 assist good contact making. A side lug 515 of the lower end 516 is formed with a hole for fixing of the bar 510.

The contact lever 520 has an arcuate middle section 522 for contacting the contact bar 510, an upper end 524 engageable by the core slider 320, and a lower end 526 fixed to the lower end of the cavity 220. The lever 520 is cantilevered for pivotal movement about its lower end 526, with its upper end 524 capable of bearing backwards resiliently against the corner recess 326 of the core slider 320. The lower end 526 includes a side lug 525, to which an electric cable 528 is connected for external electrical connection.

Figure 6:
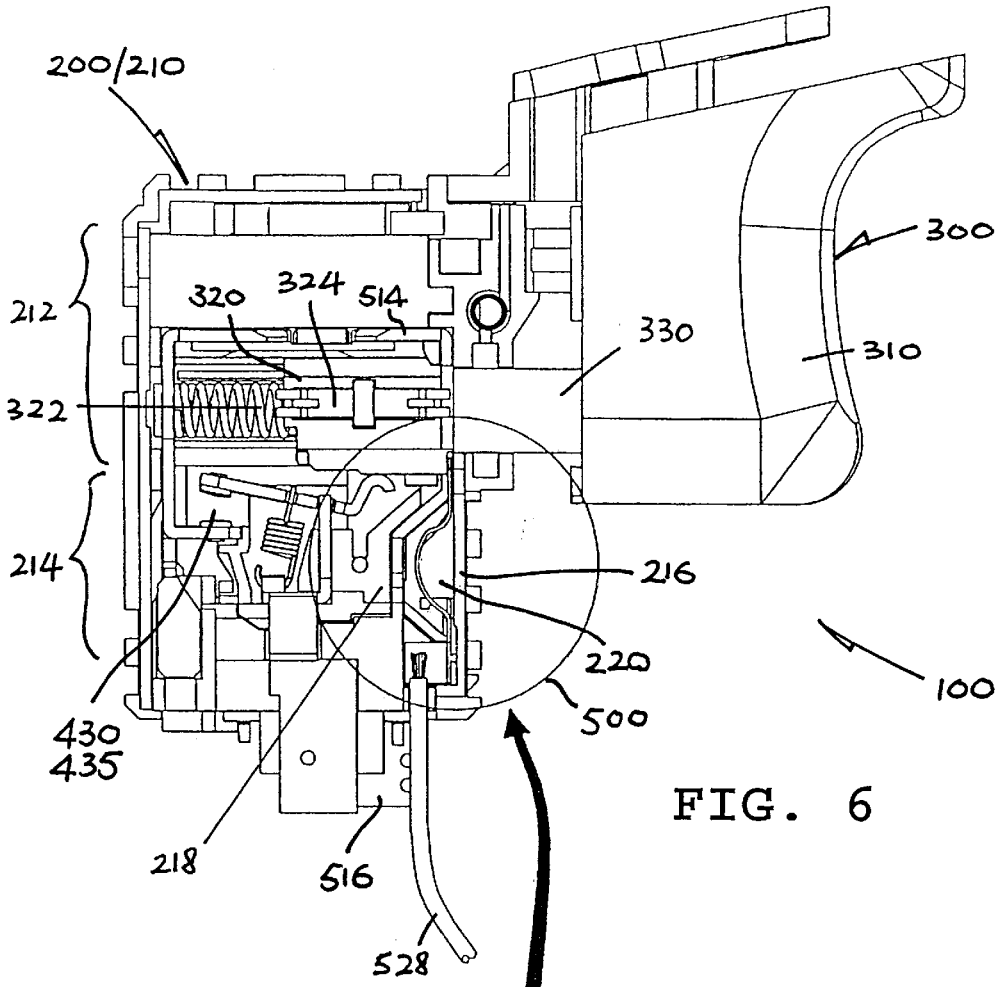
FIG. 6 is a right side internal view of the trigger assembly of FIG. 2, showing the built-in switch in an open condition.
Figure 6A:
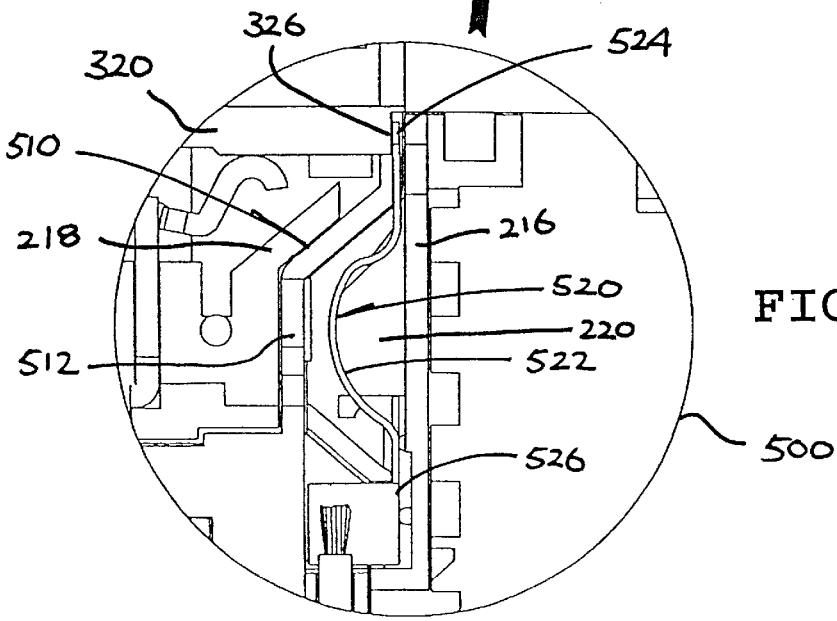
FIG. 6A is an enlarged part of FIG. 6 as encircled.
Figure 7:
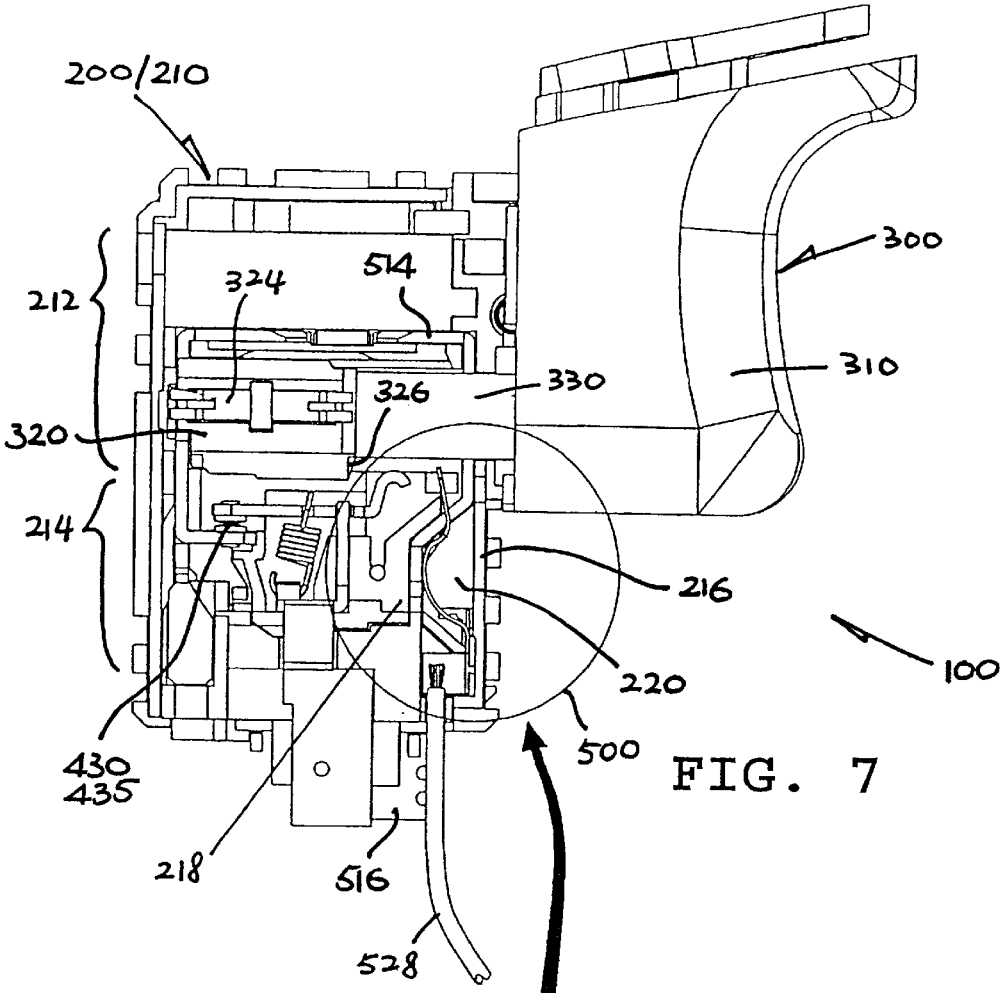
FIG. 7 is a right side internal view corresponding to FIG. 6, showing the built-in switch in a closed condition.
Figure 7A:
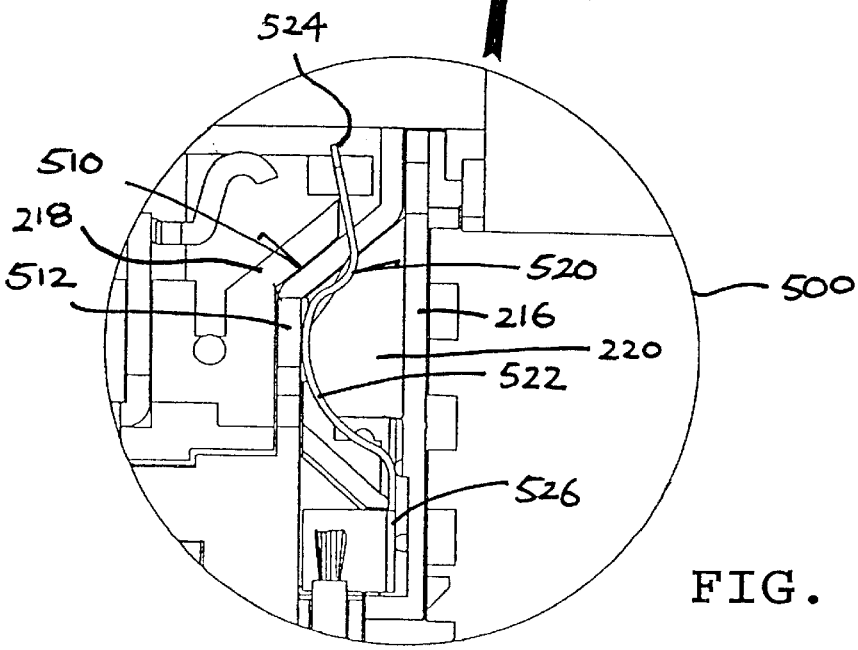
FIG. 7A is an enlarged part of FIG. 7 as encircled.
Figure 8:
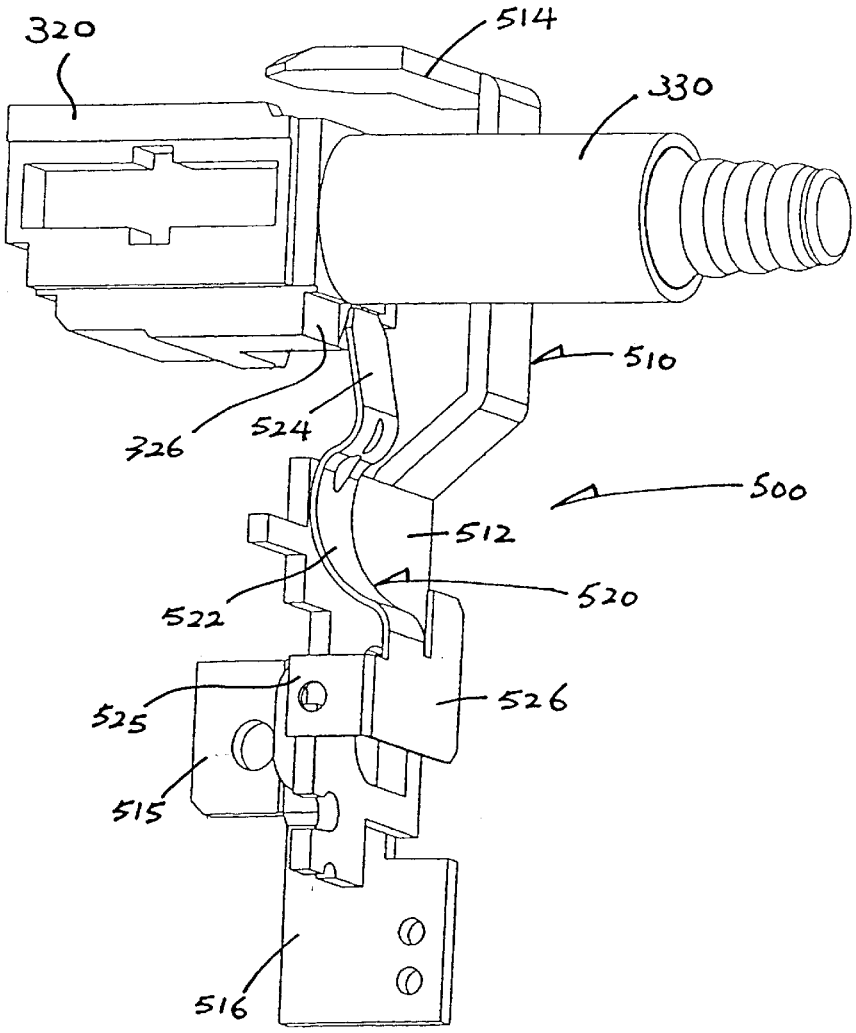
FIG. 8 is a perspective view of the built-in switch of FIG. 7, together with a slider for operating it.

While the pull-trigger 300 is in the home position, its core slider 320 abuts and thus blocks the contact lever 520 against contacting the contact bar 510, whereby the built-in switch 500 is normally open (FIGS. 6 and 6A). Upon pulling back of the trigger body 310, the slider 320 retreats and thus allows the contact lever 520 to move towards the contact bar 510. After the slider 320 has slid back to a threshold position at a certain small distance from its foremost position, the lever 520 comes into contact with the bar 510, engaging by their middle sections 522 and 512, whereby the switch 500 is closed (FIGS. 7 and 7A). The switch 500 will remain closed for as long as the slider 320 is pressed backwards beyond the threshold position, until the slider 320 is released and returns forwards past the threshold position.

The switch 500 is installed inside the trigger assembly 100 and more specifically its base 200 for switching on and off an auxiliary electrical/electronic device for the hand drill, such as a battery meter or level meter. Such an auxiliary device is located externally of the trigger assembly 100 and normally on the drill body, and is operable independently of the motor driving circuitry.

In this particular embodiment, whilst the stationary switch contact 510 is connected to the positive terminal (Vcc) of the DC battery pack, the movable switch contact 520 is connected via the cable 528 to the external auxiliary device. The built-in switch 500 serves to switch on and off the power to the auxiliary device, such that the device will be automatically turned on (or enabled) upon pressing of the trigger assembly 100.

The external auxiliary device draws a much smaller current and is more delicate than the motor 12. Due to the compact. design of the trigger assembly 100, the built-in switch 500 has to be situated very close to the main/bypass switches 430/435 as in the case of the described embodiment. In particular, the built-in switch 500 shares the same operator, i.e. the core slider 320, as the main/bypass switches 430/435.

During operation, as the contact levers of the main/bypass switches 430/435 always bear and rub against the cams of the slider 320, a small amount of their conductive material will in the course of time be transferred to the cam surface. As the material builds up on the cam surface particularly over the aforesaid region adjacent or leading to the end recess 326, a conductive surface path will inevitably be formed. In an extreme or faulty condition, the conductive path is prone to breakdown or flashover between the conducting parts of the main/bypass switches 430/435 and built-in switch 500, thereby damaging the auxiliary device. The grooves 328 minimise the risk of such breakdown or flashover by interrupting the surface of this path or extending its surface length.

The subject trigger assembly may be utilized to control any other types of electric power tools, such as a reamer, cutter or saw.

The invention has been given by way of example only, and various other modifications of and/or alterations to the described embodiment may be made by persons skilled in the art without departing from the scope of the invention as specified in the appended claims.

What is claimed is:

1. A trigger assembly for controlling the operation of an electric power tool including an electric motor, comprising:

a base for fixing within said power tool; and a trigger supported by the base for inward and outward movement;

wherein the base comprises:

a housing;

a first mechanical switch provided in the housing and operable to switch on and off said motor;

an electronic operating circuitry provided in the housing for controlling the operation of said motor when the first switch is closed;

a slider guided within the housing for movement by or with the trigger to operate the first switch and the operating circuitry; and a second mechanical switch provided within the housing and operable in response to the movement of the trigger to switch on and off an auxiliary device for said power tool, the auxiliary device being located externally of the base and operable independently of the operating circuitry.

2. The trigger assembly as claimed in claim 1, wherein the trigger is resiliently biassed towards a foremost home position, and the second switch is open when the trigger is in the home position and will be closed when the trigger is moved away from the home position.

3. The trigger assembly as claimed in claim 1, wherein the second switch comprises a stationary contact and a movable contact resiliently biassed towards the stationary contact.

4. The trigger assembly as claimed in claim 3, wherein the trigger is resiliently biassed towards a foremost home position, and the movable contact of the second switch is moved out of contact from the stationary contact by the slider while the trigger is in the home position.

5. The trigger assembly as claimed in claim 3, wherein the movable contact of the second switch is engageable by the slider against the action of resilience.

6. The trigger assembly as claimed in claim 5, wherein the slider has a front bottom part for abutting the movable contact of the second switch.

7. The trigger assembly as claimed in claim 3, wherein the movable contact of the second switch is cantilevered for pivotal movement.

8. The trigger assembly as claimed in claim 3, wherein one of the contacts of the second switch is connected to positive electrical connection of the operating circuitry.

9. The trigger assembly as claimed in claim 1, wherein the first and second switches are operable by respective first and second parts of the slider that are adjacent each other, the first part having a surface for slidably engaging a moving contact of the first switch.

10. The trigger assembly as claimed in claim 9, wherein the surface is discontinuous.

11. The trigger assembly as claimed in claim 10, wherein the surface includes a groove.

12. The trigger assembly as claimed in claim 1, wherein the housing has an upper portion housing the slider and a lower portion including a front cavity housing the second switch.

13. The trigger assembly as claimed in claim 12, wherein the housing has a frontmost outer wall and an inner wall right behind the outer wall, the two walls defining the cavity.

14. An electric power tool including an electric motor and the trigger assembly as claimed in claim 1.

15. The electric power tool as claimed in claim 14, being an electric hand drill.

* * * * *